United States Patent [19]

Boyd

[11] Patent Number: 4,506,492

[45] Date of Patent: Mar. 26, 1985

[54] APPARATUS AND METHOD FOR VOLUME FILLING OF STORAGE BOXES

[76] Inventor: Jerry L. Boyd, 2908 Caliente St., Bakersfield, Calif. 93306

[21] Appl. No.: 426,668

[22] Filed: Sep. 29, 1982

[51] Int. Cl.[3] ..... B65B 1/06; B65B 39/12; B65B 57/06

[52] U.S. Cl. ..... 53/473; 53/245; 53/260; 53/503; 53/506

[58] Field of Search ..... 53/245, 246, 248, 235, 53/236, 250, 251, 255, 260, 473, 475, 503, 504, 506, 536; 198/424

[56] References Cited

U.S. PATENT DOCUMENTS

| | | | |
|---|---|---|---|
| 2,647,670 | 8/1953 | Cox | 53/536 |
| 3,064,585 | 3/1962 | Schubert et al. | 53/236 |
| 3,848,724 | 11/1974 | Belk | 198/424 |
| 4,250,690 | 2/1981 | Lorenzen et al. | 53/245 |

*Primary Examiner*—Robert L. Spruill
*Assistant Examiner*—Richard M. Mudd
*Attorney, Agent, or Firm*—Poms, Smith, Lande & Rose

[57] ABSTRACT

A method and apparatus for volume filling of storage boxes with discrete articles such as lemons in which a transitory fill box is provided with three sides, an open side to receive articles into the box at a level approximately that of the bottom wall of the fill box, the bottom wall being openable to deposit articles in a storage box in a gentle manner. Presence of articles sensed at approximately the bottom of the open side of the fill box cause the fill box to be incrementably lowered into the storage box so that articles entering the fill box enter at a level with minimum fall to the bottom wall of the fill box or to a previously deposited layer of articles. As the fill box is lowered a curtain wall closes the open side below the point of entry of the articles. When a selected volume of articles is collected in the fill box, the bottom wall is opened to deposit the articles at the bottom of the storage box, said bottom wall including bottom wall portions which are hinged to the fill box and when open lie in vertical planes as the fill box is raised to its uppermost position to collect articles for the next storage box.

13 Claims, 9 Drawing Figures

III 35
20
32
24
36
37
100
101
52
38
75
52
105
86
-39-
102
40
104
85
85
30
53
87
87
53
81
77
42
82
103
54
54
82
38
55
55
45
46
46
45
82
31
31
43
107
-23-
-23-
III

APPARATUS AND METHOD FOR VOLUME FILLING OF STORAGE BOXES

BACKGROUND OF INVENTION

The present invention relates to bulk volume filling of articles into storage boxes, such articles, for example, including unsized color-sorted citrus fruit such as lemons or other discrete produce such as apples, plums, pears, oranges and the like. With particular reference to lemons, it will be understood that lemons are harvested in a not fully ripe state, are transported to a packing house where they are washed and cleaned and then stored in storage boxes for a period of time during which they may ripen and before sending the lemons to market. Storage of lemons may usually be in wood boxes which are stacked one upon the other. Each box may include end walls and a center partition or wall for strengthening the box. When such a storage box is filled for storage, the lemons in the box cannot exceed the height of the box walls otherwise the upper lemons will be partially crushed and damaged during stacking of the boxes. In storage of lemons in such boxes, the lemons are not required to be counted or weighed. The main requirement is that the lemons be deposited in the storage box with a minimum of or no fall and with minimum or no damage due to bruising or partial crushing of any of the lemons. The volume filling of the storage box should also be as rapidly as possible because preferably the number of boxes volume filled per hour should be in the order of 500 to 800 boxes at one filling station.

A prevalent method at the present time of volume filling of storage boxes for lemons includes the transport of lemons along a conveyor belt at a fairly rapid speed, the diversion of the flow of lemons into a storage box at one side of the conveyor, the use of a worker at such storage box to assure that the level of lemons introduced into the box does not exceed the height of the walls, and the replacement of a filled storage box with an empty storage box with minimum interruption of the virtually continuous flow of lemons on the conveyor belt. At the fill station where the lemons are diverted into the storage box, the first lemons entering the box are subjected to a fall which is approximately the height of the storage box and the spacing of the top edge of the box from the delivery edge of the delivery board leading from the conveyor belt. As the lemons fill the box, the succeeding lemons have a fall which is progressively shortened until the box is full to the top edge of the wall of the box. To reduce the fall of the lemons into the box, the worker at the fill station may be provided with a flat board which is adapted to be inserted into the box with its bottom edge adjacent the box wall close to the delivery board. This board is gradually retracted and withdrawn from the storage box as the box fills with lemons. Manipulation of the board is manual and assists in distribution of the lemons in the box. The board must be removed when the box is full and inserted in the next empty box.

The desire to reduce the fall of articles into a box to minimize damage to the articles has been evidenced in the construction of count and weigh filling of boxes adapted to ship the articles or fruit to the marketplace. Rigid requirements to assure that a box is not shipped with an undercount or underweight have resulted in apparatuses which provide for filling of a box to its almost final count or weight and then adding in virtually a discrete manner additional articles until the minimum count or weight is reached. One such prior proposed apparatus is shown in U.S. Pat. No. 3,618,285 in which the articles are deposited in a box by an elevator which extends into the box and as the box is filled, the box is lowered until at its full count or weight, the box is on a conveyor which removes the box from the fill station and introduces an empty box to the fill station where it is raised for cooperation with the elevator. Such prior apparatus reduced the fall of the fruit into the box by moving the box relative to the elevator.

SUMMARY OF THE INVENTION

The present invention contemplates a novel method and apparatus for bulk volume filling of boxes and lines in which the principal requirement for filling of the boxes is that the level of articles in the box not exceed the height of the walls of the box. The invention contemplates that the storage box be volume fed by collecting in an intermediate or transitory box an approximate volume of articles which are delivered from the article conveyor and then depositing the collected articles into the storage box in a relatively gentle manner.

An object of the invention is to provide a novel method and apparatus for volume filling of a storage box in which a transitory fill box is utilized to collect the approximate volume of articles to be deposited in the storage box.

An object of the invention is to provide such a method and apparatus of volume filling of boxes in which the fall of articles into such a transitory fill box and into the storage box is minimized so as to effectively reduce the bruising or damaging of the articles in their transfer from a moving conveyor belt to a stationary storage box.

Another object of the invention is to provide a transitory volume fill box between the delivery end of an article conveyor and a storage box in which articles moving from the conveyor into the fill box are subjected to minimum fall approximately not greater than the diameter of an article.

A further object of the invention is to provide a novel apparatus for bulk volume filling of storage boxes in which a transitory fill box is arranged to move vertically relative to the delivery board end of an article conveyor and also to a storage box positioned therebeneath so that as articles enter the fill box at approximately the level of the floor of the fill box, the fill box is incrementally lowered until its bottom wall is relatively closely spaced to the bottom wall of the storage box so that when the collected articles in the fill box are released by controlled opening of the bottom wall, their fall into the storage box is minimized.

A further object of the invention is to provide a novel method and apparatus for bulk volume filling of boxes in which the apparatus may be virtually fully automated.

Still another object of the invention is to provide an apparatus for volume filling of boxes in which means are provided to stop the descent of the fill box in the event a storage box is not in place to receive the fill box.

A further object of the invention is to provide a novel apparatus for volume filling of storage boxes in which the fill box is provided with an open side for entry of articles from the delivery board of the article conveyor, said open side being progressively closed as the fill box descends into telescopic relation with the storage box.

The invention particularly contemplates a method of filling storage boxes with discrete articles at a fill station in which the articles are delivered to an open side of a fill box at a selected level slightly above the level of the bottom wall of the fill box in its upper position and wherein a fill box is positioned at the fill station at such selected level of the bottom wall of the fill box, a storage box is positioned at the fill station below the fill box to telescopically receive the fill box, the fill box is incrementally lowered as articles are collected therein to continue to receive the articles at the selected level, the descent of the fill box is stopped when it contains deposited or collected articles of a volume approximately to fill the storage box and the fill box bottom wall is slightly above the bottom wall of the storage box, the bottom wall is then opened to gently deposit and to distribute articles in the storage box as the fill box then ascends to its upper position, ahd where the bottom wall is closed above the top of the storage box, and continuing to delivery articles into the now empty fill box while a next storage box is positioned beneath the fill box.

The invention also particularly contemplates an apparatus for volume filling of storage boxes at a fill station comprising a frame means at the intersection of an article conveyor and a storage box conveyor, a fill box at said station provided with an open side and an openable bottom wall; means for moving the flow box between an upper position adapted to receive articles through said open side at approximately the level of the bottom wall of the fill box and at a lower position within the storage box to gently discharge articles collected in the fill box into the storage box; means for opening and closing said bottom wall of the fill box; and control means for progressively incrementally causing lowering the fill box into the storage box as articles are collected in the fill box to provide minimal fall of articles entering the fill box until said fill box reaches its lower position at which the collected articles have a volume approximately that desired for the storage box; said control means opening said bottom wall for depositing said articles within the storage box and also causing said fill box to return to its upper position and to close the bottom wall for further reception of articles in the fill box through the open side thereof.

Various other objects and advantages of the present invention will be readily apparent from the following description of the drawings in which an exemplary embodiment of the invention is shown.

DRAWINGS

DETAILED DESCRIPTION

Figure 1:
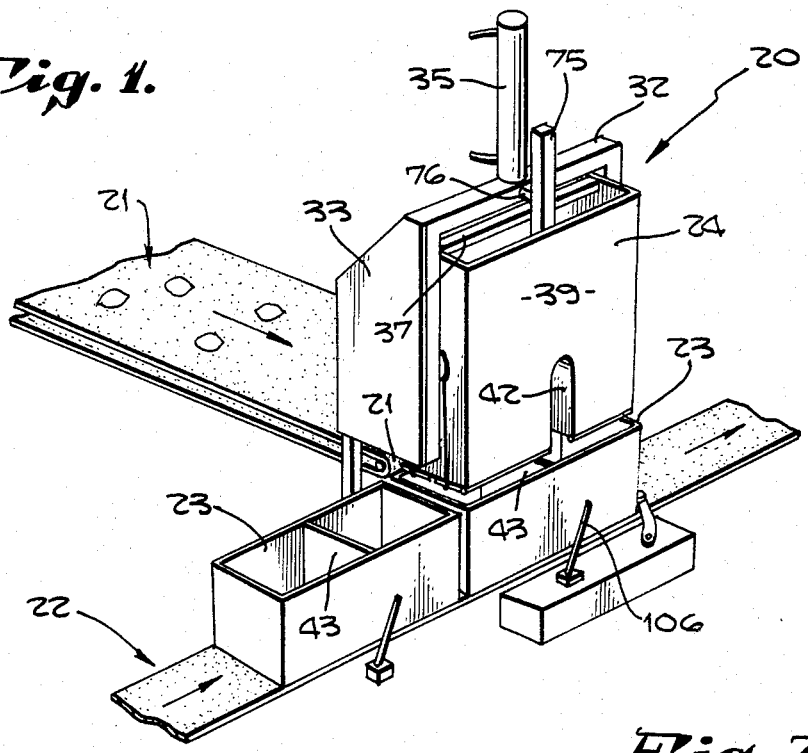
FIG. 1 is a perspective view of an apparatus for volume filling of storage boxes embodying this invention and located at the intersection of an article feed conveyor and a storage box conveyor.
Figure 3:
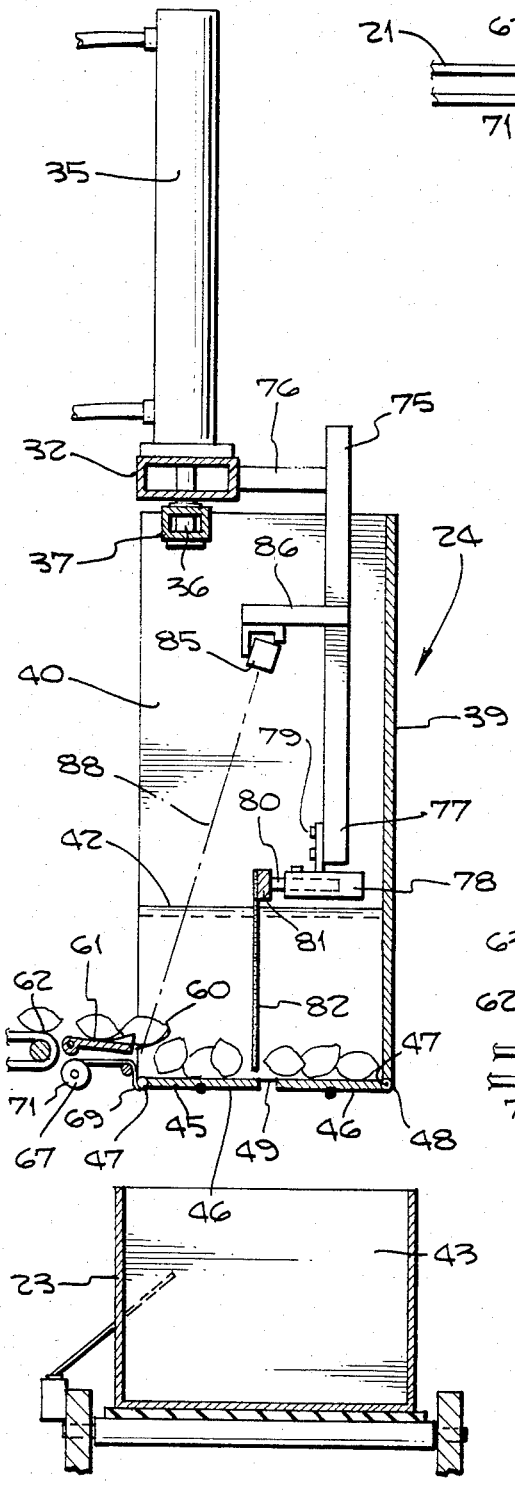
FIG. 3 is a vertical sectional view of the apparatus as shown in FIG. 1 taken in the plane indicated by line III—III of FIG. 2, the fill box being shown in upper position to receive the first articles.

In FIG. 1 an apparatus embodying this invention is generally indicated at 20. Apparatus 20 may comprise a fill station located at the T intersection of an article conveyor 21 and a storage box conveyor 22. The plane of the storage box conveyor 22 is located below the plane of the article conveyor 21 so that storage boxes 23 may be moved into position beneath a transitory or fill box 24 of the apparatus 20. In general, articles conveyed by conveyor 21 are delivered to and received on the bottom wall of the fill box 24, FIG. 3. The fill box 24 is incrementally lowered, virtually as each layer of articles is completed, into telescopic relation with the storage box 23 until a selected volume of articles are collected into the fill box 24. The fill box 24 descends to a selected lower position in the storage box where the bottom wall is opened to gently deposit the collected volume of articles into the storage box. As the fill box ascends during the article discharge operation the bottom wall is fully opened and upon reaching its uppermost position the bottom wall of the fill box 24 closes. The apparatus is then ready for its next filling cycle during which time the filled storage box is moved out of the fill station and an empty storage box is moved into place beneath the fill box 24.

Apparatus 20 comprises a frame means 30 comprising spaced upstanding columns 31 located on opposite sides of the end of article conveyor 21 and alongside the inner side of storage box conveyor 22 as viewed in FIG. 1. Frame columns 31 are interconnected at their top ends by a horizontal transverse top member of header 32. Frame and header members 31, 32 may be of any suitable structural section. Suitable side cover plates 33 may be provided.

Transitory or fill box 24 is supported from frame means 30 for vertical reciprocal movement by a cylinder and piston means 35 which is supported from transverse member 32 and which has a piston 36 extending therethrough for connection to a cross bar 37. Cross bar 37 is secured at opposite ends to end walls 38 of fill box 24. End walls 38 are connected by a back wall 39. Fill box 24 has an open side 40 which faces the article conveyor 21. Extending from the back wall 39 adjacent the bottom of fill box 24 to opening 40 may be an inverted U-shaped divider partition 42 which provides a vertical recess in the bottom wall of box 24 for reception therein of center partition wall 43 of storage box 23 to accommodate vertical telescopic relationship and movement of the fill box 24 into storage box 23. It will be understood that in the event storage boxes are used without a center partition 43 that a fill box 24 may not require a partition 42.

Fill box 24 is provided with an openable bottom wall comprising bottom wall portions 45 extending between divider partition 42 and end walls 38 of box 24. Each bottom wall portion 45 may comprise two bottom wall segments 46. Bottom wall segments 46 are respectively hingedly mounted at 47 between divider 42 and end wall 38 and to the bottom edge portion of back wall portion 48. The separation space 49 between segments 46 provides a loose tolerance between segments 46 on bottom wall portion 45 in closed position. Separation space 49 should not be greater than the size of the article to the collected in fill box 24. It will thus be apparent that each bottom wall portion 45, and segments 46 form a trap door which is openable downwardly and which, in fully opened position, the segments 46 may lie in vertical planes.

Means for controlling the opening and closing of the trap door type bottom wall may comprise in this example a piston and cylinder means 52 carried on each end wall 38, the piston 53 thereof supporting a suitable pulley 54. Pulley 54 supports a suitable length of flexible wire cable 55 each end of which is attached in suitable manner as at 56 to a central portion of the side edge of a segment 56. In closed position of the bottom wall, piston 53 is retracted in the cylinder 54 and the cable 55 is under tension to support the collection of lemons or articles in fill box 24. When piston 53 is in downward projected position the slack afforded to the cable 55 by such down position of the pulley 54 permits the segments 46 to open about their hinged mounting under the weight of the articles to discharge the articles onto the bottom wall of the storage box. Since the opening of the bottom wall segments 46 is under the control of the cylinder means 52 the opening may be controlled in a slow or retarded manner so that the articles are gently deposited on the bottom wall of the storage box.

Figure 8:
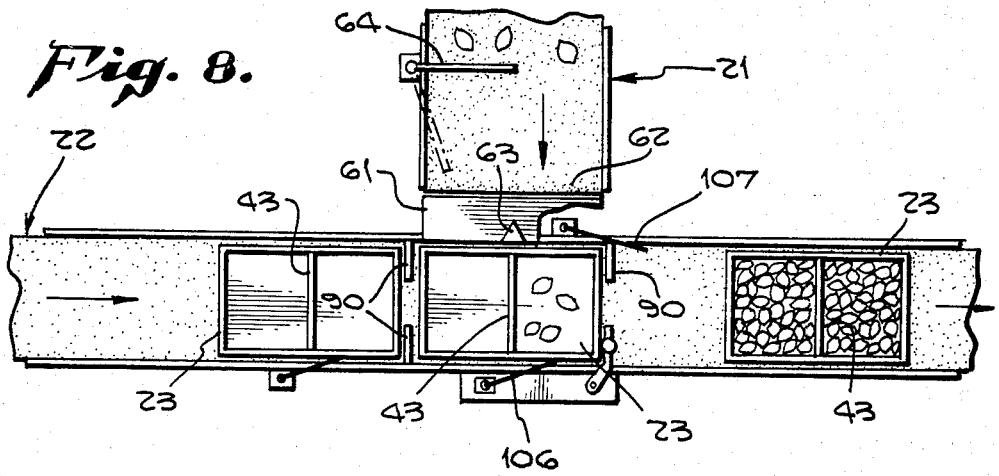
FIG. 8 is a fragmentary schematic top plan view of the inner section of the article conveyor and storage box conveyor to illustrate location of certain switch means on the storage box conveyor and also a movable shear or gate on the article conveyor to control the flow of articles into the fill station.

In upper position of fill box 24 the open side 40 of the fill box allows entry of the lemons into the fill box at a selected level in which the bottom wall of the fill box is slightly below the discharge edge 60 of a pivotally mounted delivery board 61 which spans the space between the end 62 of article conveyor 21 and the front edge of the bottom wall of fill box 24. The delivery board 61 extends across the width of the opening 40 and, in this example, is provided with a triangular divider 63 for separating flow of lemons on the conveyor 21 into two paths to direct the lemons into the fill box compartments on both sides of fill box partition 42. Directional flow of lemons on conveyor 21 may also be regulated by a pivotally mounted shear member or gate 64 provided a selected distance upstream of delivery board 61 and in this example shown in FIG. 8 as being pivotally mounted on the left side of conveyor 21 and extending only to the centerline of the conveyor belt. The shear or gate 64 may be fully opened to permit flow across the entire width of conveyor 21 and may be regulated as later described by positioning the shear member 64 at a selected angle to divert the stream of lemons toward a fill box compartment as desired.

Figure 4:
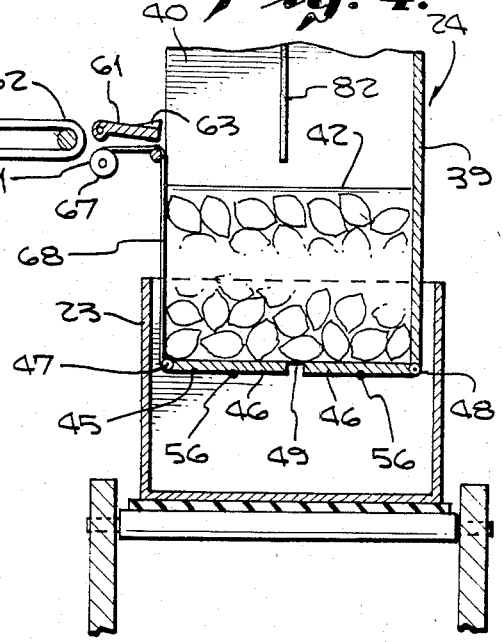
FIG. 4 is a fragmentary view taken in the same plane as FIG. 3 showing the fill box with a selected volume of articles collected therein and in a lowered position.

With lemons being fed from the delivery board to the bottom wall at a selected level at which the drop of lemons may be not more than one-half the diameter of the lemons and as the fill box is incrementally dropped to lower positions, means 67 are provided for open side 40 to be closed during such lowering of box 24 and also to be progressively opened as box 24 is raised. Means 67 may comprise a pliant flexible curtain-like sheet of material 68 having its free end connected to the front edge of the bottom wall in any suitable manner as at 69. The curtain 68 may be guided over a suitable transverse guide rod 70 carried by frame means and positioned just beneath the delivery board 61. The curtain 68 may be wound upon a spring biased supply roll 71, which may be similar to a window shade roller. As the bottom wall is progressively incrementally lowered the pliant curtain sheet material is drawn from the supply roll 71 and temporarily closes the open side 40 of the box 24 in its lower positions, such closure being shown in FIGS. 4 and 5. As the box is raised the curtain 68 is retracted on the supply roll 71 and provides the box open side 40 above the delivery board 61. The material of the curtain 68 is preferably reinforced and under tension so that when the fill box 24 contains the selected volume of articles as shown in FIG. 4 the material of the curtain wall 68 will not bulge outwardly so as to obstruct the telescopic movement of the fill box 24 into the storage box.

Means for regulating the level of the lemons in the fill box 24 by lowering fill box 24 includes a vertically disposed support member 75 having its upper end connected to transverse member 32 by a suitable bracket member 76. Member 76 may be fixedly connected to transverse member 32. The upper end portion of the vertical support member 75 may be adjustably connected to the end of bracket 76 to adjust the vertical relationship of member 75 relative to the recripocally movable fill box 24 into which support member 75 extends. At the bottom end 77 of member 75 a horizontally extending support bracket 78 may be adjustably attached thereto as at 79 to permit vertical adjustment of bracket 78 relative to member 75. Bracket 78 provides slidable adjustment for a forwardly extending member 80 which fixedly carries at its outer end a horizontal transverse bar 81. This adjustment permits selected positioning of bar 81 toward and away from the opening 40 of box 24 and from the delivery board 61. Bar 81 is provided with a plurality of strips 82 of pliant yieldable material the strips extending into the zone of the first layer of articles when the fill box 24 is in its uppermost position. When lemons move across delivery board 61 and onto the bottom wall of the fill box 24 their momentum is broken by contact with the strips 82 so that while some lemons may pass to the back side of strips 82 other lemons will begin to back up to the edge of the delivery board. When this occurs the presence of lemons at the edge of the delivery board is sensed by sensing means 85 which as later described causes the fill box 24 to drop an incremental amount to relieve the back up of lemons and to permit oncoming lemons to be fed into the box with minimum fall.

Sensing means 85 are supported from vertical support member 75 by a bracket member 86 which extends forwardly of member 75 and is provided with slightly downwardly inclined oppositely directed wing portion 87. Mounted on wing portions 87 are the sensing means 85 which are adjustably positioned so as to sense a lemon at a selected area along the edge of the delivery board.

In this example the photosensing means 85 is of a type to emit a light beam 88 directed toward the delivery board edge portion and to sense the presence of a lemon by reflection of the light beam from the surface of the lemon. Preferably the light beam is fan shaped so as to permit reflection over a selected width which may include more than one lemon. The surface of the delivery board may be provided with a non-reflective coating to assure that the sensing means 85 does not read the presence of a lemon when there is no lemon at the delivery board.

As later described since the lemons are moving across the delivery board at a selected rate of speed, sensing means 85 is provided with a time delay factor so that it will not cause actuation incremental lowering of a box upon the sensing of reflection of a lemon moving across the delivery board, but will only cause such actuation of the lowering of box 24 when there has been sufficient back up of lemons to the delivery board edge so that the sensed reflection is retained for time such as 0.10 seconds. It will be apparent that pliant strips 82 suitably vertically and forwardly positioned will contribute to the desired amount of backup of lemons toward the delivery board to facilitate timely incremental lowering of box 24 to maintain the lemons at a selected level.

Two sensing means 85 are provided in this example because of the separation of the storage box into two compartments and the separation of fill box 24 into two filling compartments as defined by central partition 42. Since the flow of lemons on the conveyor 21 vary in uniformity crosswise and lengthwise of conveyor 21 it is not desired that the fill box 24 be lowered until the lemon level requirements are achieved in each of the fill compartments. In this example of the invention and as later described, both sensing means 85 must be satisfied as to the lemon level before the fill box is incrementally lowered for accepting another layer of lemons at or just below the plane of the delivery board edge. Diversion of flow of lemons into the separate compartments is facilitated by divider member 63 on the delivery board. In the event the filling of the fill compartments of box 24 is extremely nonuniform then means are provided for the actuation of shear 64 to divert more lemons into one or the other of the fill compartments.

Figure 6:
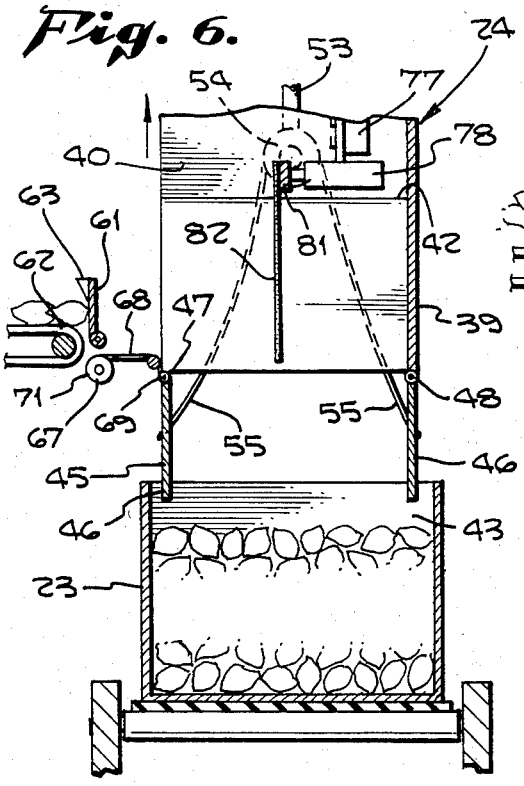
FIG. 6 is a fragmentary view taken in the same planes as FIGS. 3, 4, and 5 showing ascent of the fill box to its upper position and the articles deposited in the storage box.
Figure 7:
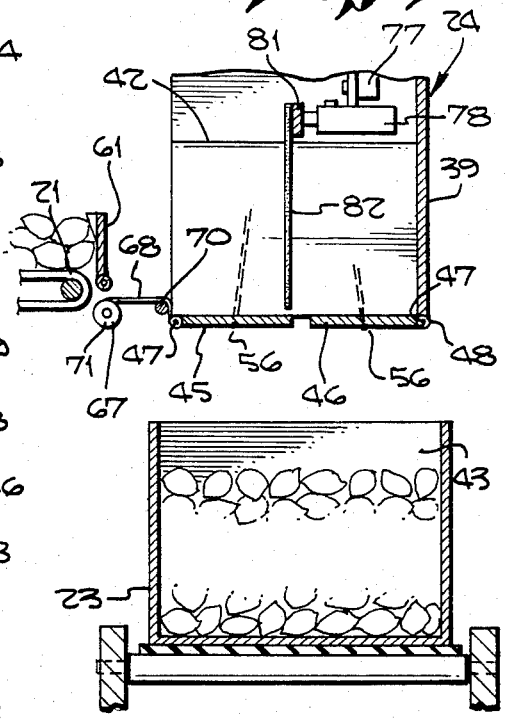
FIG. 7 is a fragmentary view taken in the planes indicated by FIGS. 3, 4, 5, and 6 showing the fill box in uppermost position with the bottom floor moved to closed position ready to receive articles through the open side of the fill box.
Figure 2:
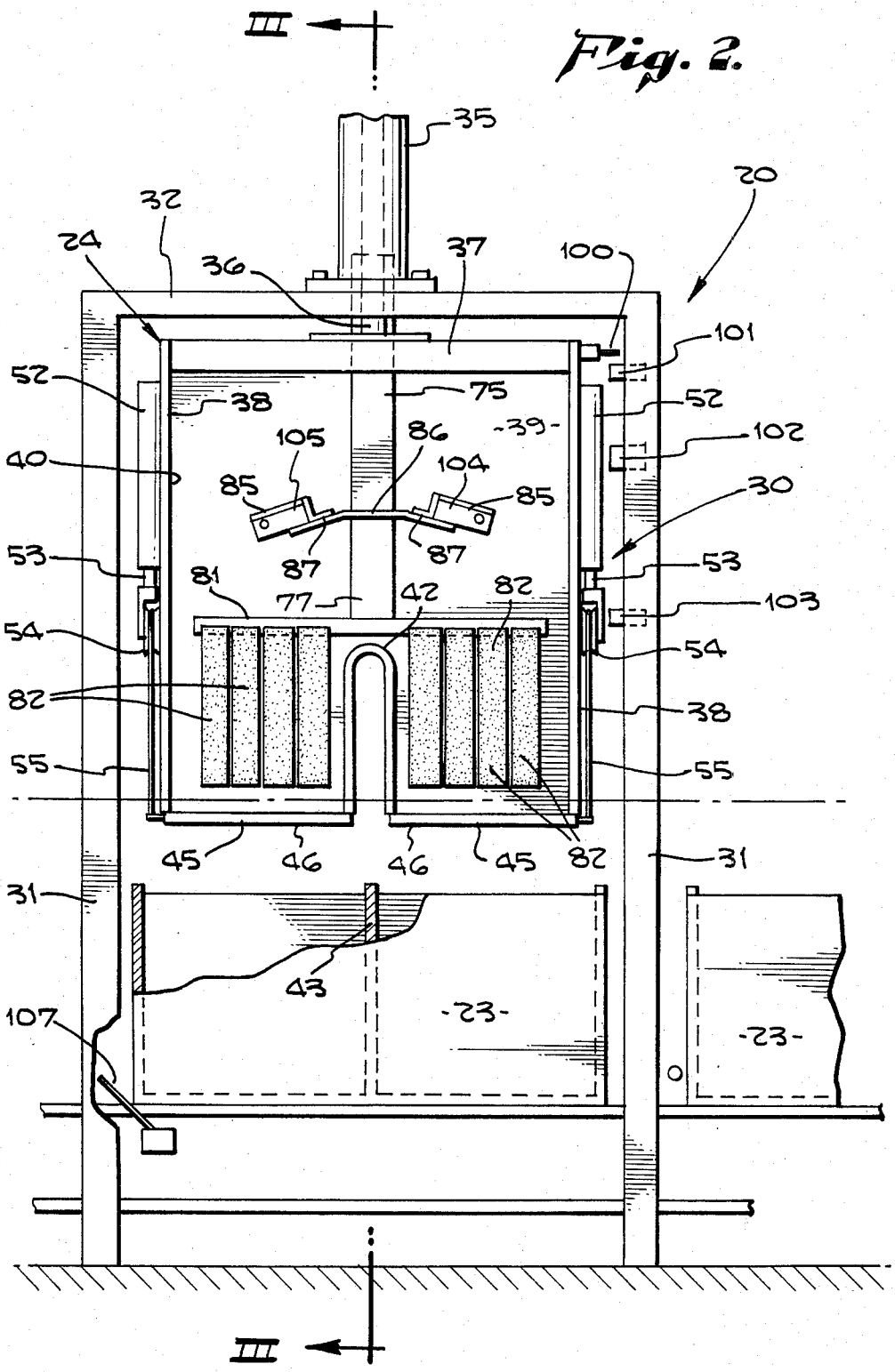
FIG. 2 is a enlarged fragmentary view of the apparatus shown in FIG. 1, the view being taken in a vertical plane transverse to the article conveyor and showing the apparatus in elevation with the article conveyor removed, a portion of the storage box conveyor being shown in position for filling, the view looking into the open side of the volume fill box.
Figure 5:
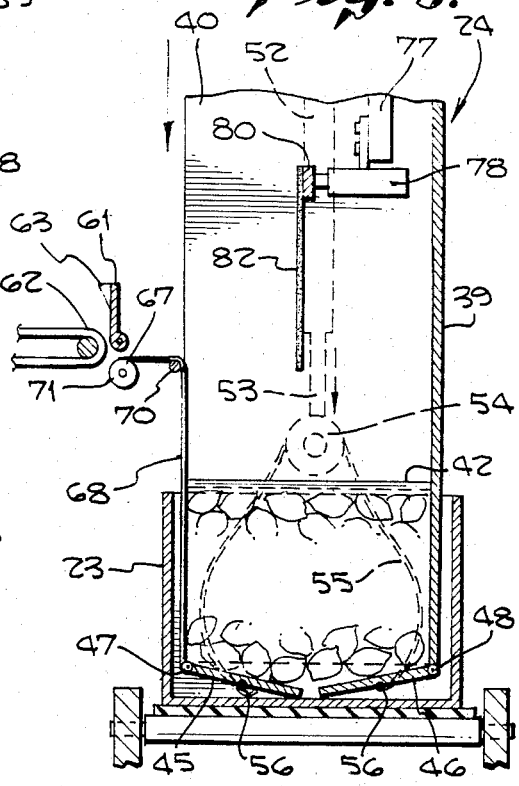
FIG. 5 is a fragmentary view taken in the same plane as FIGS. 3 and 4 and showing the fill box in lowermost position ready to gently discharge the collected articles into the storage box.

When volume fill box 24 has received the selected volume of articles the box may be lowered further into the storage box, if necessary, before opening the bottom wall to deposit the collected articles in a gentle manner in the storage box. When the selected volume of articles in the fill box is reached delivery board 61, which is pivotally mounted from the conveyor 21 frame, is actuated to a substantially vertical position as shown in FIGS. 5 and 6 to serve as a gate and to obstruct further immediate flow of lemons into the fill box while it is discharging the selected volume of collected lemons into the storage box. Means for actuating delivery board 61 to a vertical position may comprise a suitable means such as a piston or cylinder connected to the delivery board by suitable linkage. When the fill box 24 returns to upper position as shown in FIG. 7 the delivery board is actuated to its downwardly inclined delivery position to permit lemons to be fed into the open side of the box 24. It will be understood in some installations that instead of a pivotally mounted delivery board serving as a gate, separate means may be provided such as modifying the shear 64 to extend entirely across the conveyor 21. Such gates for stopping flow of articles on a moving conveyor belt are well known in the industry.

Control means for apparatus 20 will be described in connection with the schematic circuit diagram shown in FIG. 9. In describing the operation of apparatus 20 and the method of this invention it will be understood from a consideration of FIG. 1 and FIG. 8 that the storage box conveyor 22 is supplied with a quantity of empty storage boxes in well known manner such as by advancing the boxes on an inclined conveyor path to the storage conveyor 22 which may comprise a non-movable conveyor surface having on opposite longitudinal sides driven sprocket chains each provided with inboardly extending box engaging arms 90, FIG. 8, which contact the back wall of a box to advance the box 23 along the conveyor. The driven sprocket chains are indexed so that the box engaging arms 90 will position box 23 directly beneath fill box 24, the chains being intermittentaly actuated for this purpose.

The lemons carried by conveyor 21 may be fed to the conveyor 21 in any well known manner and the path of the lemons may be deflected or divided by suitably positioned shear members or gates such as 64. It will be understood that the conveyor 21 is provided with side walls (not shown) to contain the lemons thereon.

Figure 9:
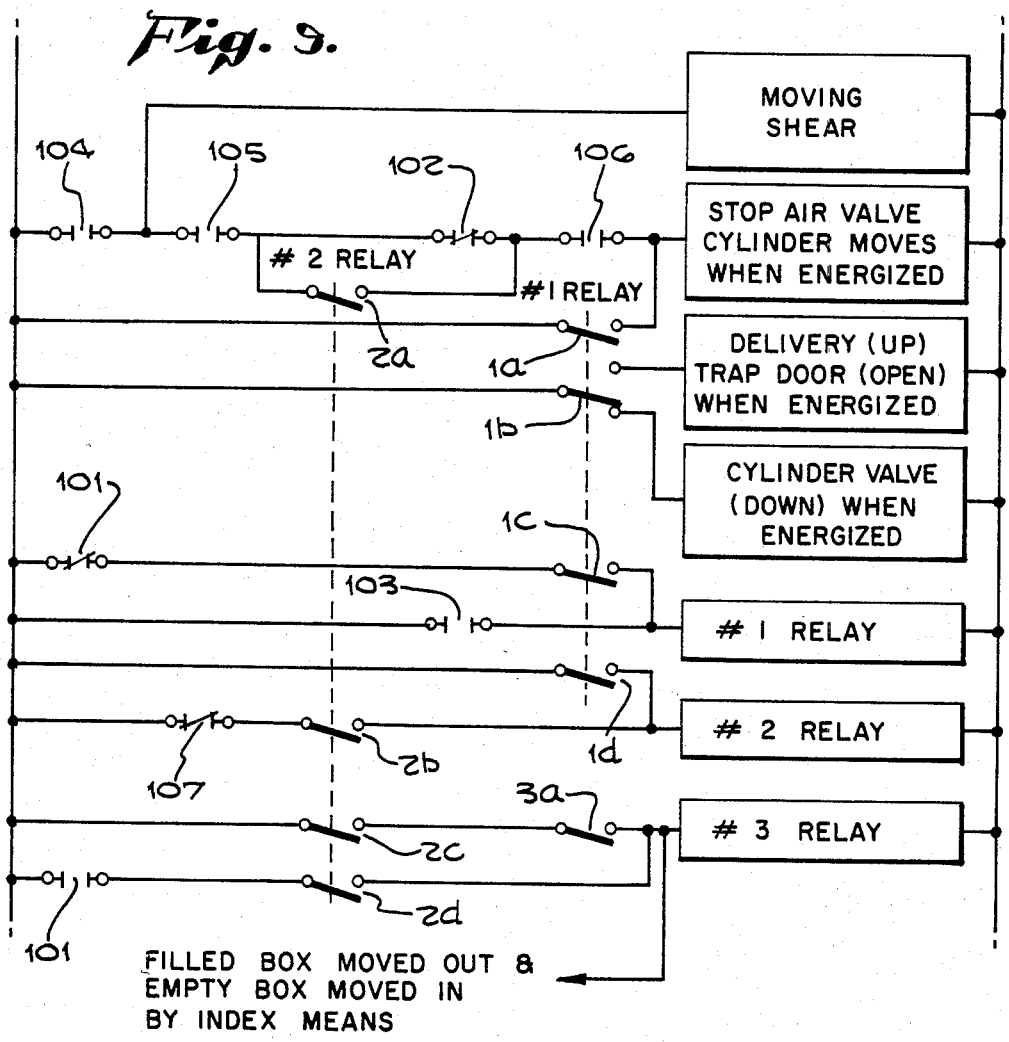
FIG. 9 is a schematic circuit arrangement for controlling the apparatus shown in FIG. 1.

Identification of switches shown in FIG. 9 and their location on the apparatus shown in the drawings includes switch 101 located on a vertical column 31 inboardly and adjacent the top thereof for engagement by a switch contact arm 100 carried at the top of fill box 24 adjacent the open side thereof and on the top edge portion of wall 38. Switch 102 is spaced below switch 101 and is mounted on column 31 also for engagement by contact arm 100. Switch 103 is spaced further below switch 102 and adapted to be contacted by contact arm 100 to be activated when box 24 comes to its full lowermost position. Switch 104 and switch 105 are photo reflective switches carried by the sensing means 85. Switch 106 is located outboardly of the storage box in fill position and is actuated by the engagement of the presence of a box in the fill station. Switch 107 is located on the inboard side of a storage box 23 in the fill station and is located so that its switch arm is normally not in engagement with the box when it is in the fill station and is contacted when the full storage box is moved out of the station.

In operation at the start of a filling cycle, switch 106 which is normally open, has been closed by the presence of a storage box 23 at the fill station. If no storage box is at the station, switch 106 remains open and cylinder 35 is not actuatable to cause lowering of the fill box 24. In this connection, it should be noted that cylinder 35 may be of coaxial type comprising an air-hydraulic cylinder which employs a stop air valve which controls the hydraulic operation of the piston and cylinder. A stop air valve is provided which is closed position causes the hydraulically operated piston to stop and when in open position, permits the piston to move. A typical coaxial air-hydraulic cylinder having such a mode of operation is identified as a coaxial air/hydraulic cylinder made by Aro Corporation of Bryan, Idaho. Switch 106 is a single pole single throw normally open switch.

With the fill box in uppermost position switch 101 is mechanically actuated by switch arm 100 carried on the fill box. Switch 101 includes a normally closed contact which serves as a hold interlock for relay number 1. The normally opened contact of switch 101, when closed, closes contacts *2a, 2b, 2c, 2d* in the number 2 relay. With the number 2 relay contact *2a* closed and switch 106 closed, the circuit for the stop air valve cylinder in cylinder means 35 is in condition for actuation by the level sensing normally open switches 104 and 105, as the lemons move across the delivery board and the reflection therefrom is sensed by the pair of sensing means 85. When the switch 104 above the left fill compartment is closed by reflection from lemons and while the time delay period lapses, switch 104 remains closed until the sensing means 85 for the right fill compartment has responded thru switch 105 to the reflection from the lemons entering the right fill compartment and after its time delay, switch 105 will close. Upon momentary closure of both switches 104 and 105, the stop air valve in cylinder means 35 is energized to cause the fill box to be incrementally lowered a selected distance. Such incremental descent of the fill box is intermittently controlled by the action of both switches 104 and 105 since when the box is lowered on incremental amount, the backup of the lemons at the delivery board is relieved and the reflection switch system of switches 104 and 105 opens as the lemons move toward the back of the fill box and thus temporarily de-energizes the stop air-valve so that lowering of the box is stopped. Such intermittent lowering of the fill box which is dependent upon the combined actuation of switches 104 and 105 and the reflection from lemons at a selected level at the delivery board, continues until the fill box and its contact 100 engages switch 103.

When switch 103 is closed, the number 1 relay is actuated which causes closure of the number 1 relay contacts 1*a*, 1*b*, 1*c*, 1*d* shown on the schematic diagram. Under these conditions, the stop air-valve in the cylinder 35 is energized to cause the fill box to be raised toward its uppermost position. At the same time, number 1 relay contact 1*b* is closed which actuates the delivery board into up position and also causes the trap door bottom floor of the fill box to open by actuation of the cylinder means 52 to permit the trap doors to be lowered to open position. When the fill box reaches its uppermost position, the top switch 101 is again actuated to commence another cycle, but only if the storage box which is now filled with the lemons collected by the fill box moves out of its fill station and contacts the normally closed switch 107 which is then opened. Switch 107 provides an interlock with switch 102 and serves as a hold circuit for the number 3 relay.

The circuitry for actuation of the sprocket and chain means with projecting box lugs for indexing the position of a storage box under the fill station is not described because such circuitry is well-known, the connection to such index means being at number 3 relay on the circuit diagram in FIG. 9.

it will be apparent from a description of the schematic circuit diagram that the incremental downward movement of the fill box is controlled by the presence or absence of lemons at the delivery board at a selected level and that the system requires the presence of lemons at both fill compartments from which reflection from the lemons is read by the sensing means 85 for actuation of switch means 104 and 105. Further, when such switch means 104 and 105 do not sense the presence of a lemon, they are opened and as a result, the downward movement of the box is stopped because the circuitry indicates that the stop air valve in the coaxial air-hydraulic cylinder which controls the hydraulic side of the cylinder will be in closed position and will stop piston travel. When both switch means 104 and 105 are closed, the stop air valve is opened to permit the hydraulics in the cylinder to move the piston downwardly until valves 104 and 105 are opened again.

It will be understood, of course, that other means may be used for controlling the incremental downward movement of the fill box. Other suitable means may include a mechanical rack and pinion arrangement, a chain and sprocket means, and other types of hydraulic means. Further, in the example described above, the photosensitive means 85 are described as a reflection type sensing means. It will be understood that other means may be used for sensing the presence of lemons at a selected level at the delivery board entrance into the fill box. For example, the presence of lemons at a selected level on the delivery board may be sensed by air actuated means in which the delivery board may have a perforated top surface in which the openings lead to a plenum chamber maintained under selected air pressure so that the presence of a lemon over a perforation for a selected length of time would indicate a backup of lemons in the fill box to cause the fill box to be lowered an incremental amount until the air pressure sensing switch returned to its normal position.

It may also be noted that the trap door of the fill box is not actuated to open position until the bottom wall of the fill box is within, for example, a few inches of the bottom wall of a storage box. Thus, when the trap door slowly opens under control of the trap door cylinder means, the weight of the collected lemons will cause them to be gently deposited on the bottom wall of the storage box. As the fill box moves to its uppermost position, the trap doors move downwardly and outwardly about their hinged connection to the fill box and assume a position in a vertical plane which is virtually the same vertical plane as that of the back wall of the fill box and the plane of the open side of the fill box and the progressively retracted curtain wall 68.

While the invention has been illustrated with respect to a partitioned storage box for lemons, it will be understood that other types of receptacles or containers may be filled with discrete articles in virtually similar manner. For example, a large bin without a partition therein may be filled by a fill box of correspondingly enlarged volume supported and adapted to be incrementally, telescopically received within the bin for gently depositing the discrete articles in the bin in the manner as described above.

Various other changes and modifications may be made in the structure and mode of operation of the volume fill means described above which come within the spirit of the invention and all such changes and modifications coming within the scope of the appended claims are embraced thereby.

I claim:

1. In a method filling storage boxes with discrete articles such as lemons, at a fill station in which the lemons are delivered to an open side of a fill box at a selected level with the fill box in upper positions thereof; the steps of:

positioning a fill box at the fill station to receive lemons through the open side at approximately the level of the bottom wall of the fill box;

positioning a storage box at the fill station below the fill box to telescopically receive the fill box as lemons collect therein;

incrementally lowering the fill box as lemons collect therein to continue to receive lemons at the selected level;

progressively closing the open side of said fill box during descent thereof to retain lemons therein;

stopping the descent of the fill box when it contains deposited lemons of a volume to approxiately fill the storage box;

opening the bottom wall to deposit and to distribute lemons in the storage box as the fill box ascends to its upper most position with the bottom wall at about said selected level;

closing the bottom wall above the top of the storage box;

and continuing the delivery of lemons into the now emptied fill box while a second storage box is being positioned beneath the fill box.

2. A method as stated in claim 1 including the step of:

progressively opening said open side of the fill box during ascent of the fill box after depositing and distributing lemons in the storage box.

3. An apparatus for volume filling of storage boxes at a fill station comprising in combination:

a frame means;

a fill box having an open side and supported from the frame means and adapted to receive articles from one direction through said open side and to discharge articles in another direction into storage means;

means for moving the fill box in accordance with the quantity of articles received therein;

means for closing and opening said open side of said box;

and means for controlling said fill box moving means to minimize travel of articles into said fill box and for controlling the means for closing and opening the said open side to correspond with the presence or absence of articles in said fill box.

4. An apparatus for volume filling of storage boxes at a fill station provided at the intersection of a storage box conveyor for moving empty and full storage boxes and an article conveyor in which the filling station comprises the combination of:

a frame means at said conveyor intersection;

a fill box supported from said frame means and having an open side and an openable bottom wall;

means for moving said fill box between an upper position adapted to receive articles from said article conveyor through said open side at approximately the level of the bottom wall of the fill box and a lower position within the storage box to discharge articles collected in said fill box into the storage box;

means for progressively closing the open side of said fill box and for progressively opening the open side of the said fill box during the descent and ascent respectively of the fill box; and means for opening and closing said bottom wall of said fill box;

and control means for progressively lowering the fill box into the storage box as articles are collected in the fill box to provide minimized fall of articles entering said fill box until said fill box reaches said lower position;

said control means opening said bottom wall for depositing said articles within said storage box;

said control means causing said fill box to return to its upper position and to close said bottom wall thereon for further reception of articles in said fill box through said open side thereof.

5. An apparatus as stated in claim 4 wherein said control means includes sensing means carried on said frame means for determining the presence of articles at about the level of the end of said article conveyor.

6. An apparatus as stated in claim 5 wherein said openable bottom wall of said fill box includes bottom wall portions hinged for movement between a bottom wall closed position and a bottom wall open position in which the bottom wall portions lie in a vertical plane.

7. An apparatus as stated in claim 6 including means on said fill box for opening and closing each of the bottom wall portions.

8. An apparatus as stated in claim 5 including:

means for adjusting the sensing means to detect the presence of an article at a selected level adjacent the bottom wall of the fill box and the end of the article conveyor.

9. An apparatus as stated in claim 4 wherein said means for progressively opening and closing said open side of said fill box includes:

a curtain-like sheet of material having one end connected to the bottom of said fill box and the other end connected to said frame means adjacent the end of the article conveyor.

10. An apparatus as stated in claim 9 including means for retracting said sheet of material when said fill box ascends.

11. An apparatus as stated in claim 4 including:

means carried by the frame means for leveling movement of articles entering the fill box through said open side from the article conveyor.

12. An apparatus as stated in claim 11 wherein said leveling means includes:

a pliant curtain supported from said frame means with lower curtain portions intermediate the open and back sides of said fill box and spaced just above the bottom wall of the fill box in its upper position.

13. An apparatus as stated in claim 12 including:

sensing means for determining the presence of an article at a selected level;

said leveling means including means for delaying response of said sensing means to limit progressive lowering of said fill box to level conditions of articles in said fill box.

* * * * *